US007055862B2

(12) United States Patent
Viby

(10) Patent No.: US 7,055,862 B2
(45) Date of Patent: Jun. 6, 2006

(54) LABEL AND LEVER ARCH FILE OR RING

(75) Inventor: Henning Viby, Herlev (DK)

(73) Assignee: Dry Label Denmark APS (DE)

( * ) Notice: Subject to any disclaimer, the term of this patent is extended or adjusted under 35 U.S.C. 154(b) by 678 days.

(21) Appl. No.: 09/514,723

(22) Filed: Feb. 28, 2000

(65) Prior Publication Data

US 2002/0096874 A1 Jul. 25, 2002

Related U.S. Application Data

(63) Continuation of application No. 08/750,721, filed as application No. PCT/DK95/00239 on Jun. 14, 1995.

(51) Int. Cl.
*B42D 15/00* (2006.01)

(52) U.S. Cl. ..... 283/81; 283/101; 283/105; 40/299; 40/630; 40/641; 281/31; 428/42.2; 428/42.3

(58) Field of Classification Search ..... 283/101, 283/105, 81; 40/299, 630, 641; 281/31; 428/42.2, 42.3

See application file for complete search history.

(56) References Cited

U.S. PATENT DOCUMENTS

| | | | | | |
|---|---|---|---|---|---|
| 1,865,741 | A * | 7/1932 | Carney | 281/31 |
| 2,434,545 | A * | 1/1948 | Brady, Jr. et al. | 206/447 |
| 2,681,732 | A * | 6/1954 | Brady | 206/447 |
| 2,883,044 | A * | 4/1959 | Kendrick | 206/447 |
| 3,361,252 | A * | 1/1968 | Wise | 206/447 |
| 3,568,829 | A * | 3/1971 | Brady, Jr. | 206/447 |
| 4,368,903 | A * | 1/1983 | Jones | 283/21 |
| 4,940,258 | A * | 7/1990 | Cuba, Jr. et al. | 283/101 |
| 5,219,183 | A * | 6/1993 | McKillip | 283/81 |
| 5,389,414 | A * | 2/1995 | Popat | 283/105 |
| 5,418,026 | A | 5/1995 | Dronzek, Jr. et al. | |
| 6,103,326 | A * | 8/2000 | Kobayashi | 283/101 |
| 6,306,485 | B1 * | 10/2001 | Keller | 428/194 |
| 6,368,688 | B1 * | 4/2002 | Crum et al. | 428/41.8 |
| 2004/0101646 | A1 * | 5/2004 | Hodsdon et al. | 428/40.1 |
| 2004/0213943 | A1 * | 10/2004 | Viby | 428/40.1 |

FOREIGN PATENT DOCUMENTS

| | | |
|---|---|---|
| DE | 22 57 435 | 12/1984 |
| DE | 88 07 521.4 | 6/1988 |
| DE | 42 40 825 | 6/1994 |
| EP | 0 299 598 | 1/1989 |
| EP | 297 705 | 1/1989 |
| EP | 0 341 328 | 11/1989 |
| EP | 389 112 | 9/1990 |

(Continued)

*Primary Examiner*—Boyer Ashley
*Assistant Examiner*—Mark Henderson
(74) *Attorney, Agent, or Firm*—Fitch, Even, Tabin & Flannery

(57) ABSTRACT

A label assembly comprises a support sheet of a paper material defining opposite surfaces, an adhesive coating applied to one side of the support sheet, and a printing paper defining opposite front and rear surfaces. The rear surface of the printing paper is releasably fixed to the support sheet in facial contact therewith through the adhesive coating and the printing paper is divided into individual paper labels or paper tags which are individually removable from the support sheet. The label assembly constitutes a label assembly which is readily printable in a laser jet or any similar printing machine such as an ink jet printer or a typewriter which label system consequently rendering it possible to provide a printing on a specific label for identifying a lever arch file or ring binder by means of the label assembly.

26 Claims, 4 Drawing Sheets

FOREIGN PATENT DOCUMENTS

Figure 1:
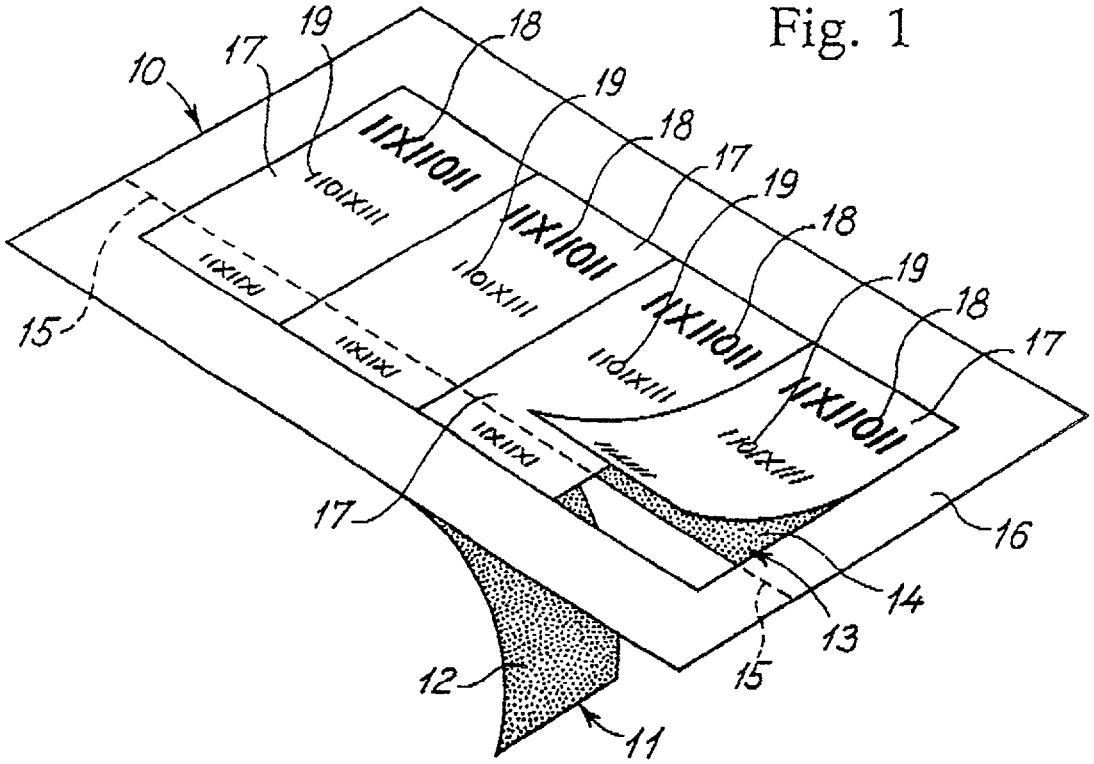

| | | | |
|---|---|---|---|
| EP | 0 416 862 | A2 | 3/1991 |
| EP | 0 514 625 | A2 | 11/1991 |
| EP | 0488813 | A2 * | 3/1992 |
| EP | 488 813 | | 6/1992 |
| EP | 0 597 609 | A1 | 5/1994 |
| EP | 0 613 792 | A1 | 9/1994 |
| EP | 0 690 794 | | 1/1995 |
| NO | 156959 | | 9/1987 |

* cited by examiner

LABEL AND LEVER ARCH FILE OR RING

This application is a Continuation of application Ser. No. 08/750,721, filed Feb. 10, 1997, which is a National Stage PCT Application of PCT/DK95/00239, filed Jun. 14, 1995, which claims priority to Denmark application 0698/94, filed Jun. 15, 1994 which application(s) are incorporated herein by reference.

The present invention relates to a label system and a lever arch file or ring binder.

Conventional lever arch files or ring binders are provided with a transparent pocket provided at the back of the lever arch file or ring binder in which pocket a label may be received. The label serves the purpose of identifying the lever arch file or ring binder in question and is usually pre-printed including a number of lines allowing the user to write a short combination of letters and integers by means of a pencil or pen e.g. a ball point pen. The label is usually made from cardboard and presents a fairly rigid body which is, due to the small size of the label and the rigidity of the cardboard material, not readily printable in e.g. laser printers or ink jet printers or alternatively type writers for providing a printing on the label.

A conventional label system is known including a support sheet constituting a release paper and a printing paper provided with an adhesive coating at the rear surface of the printing paper. Attempts have been made to modify the conventional label system so as to make the label system usable in connection with lever arch files or ring binders as the adhesive coating of the printing paper has been provided as a dry adhesive. These attempts, however, have not been successful as the dry adhesive is not compatible with the high temperature treatment which the dry adhesive is exposed to in e.g. a laser printer. In case the conventional label system including a dry adhesive is used in a laser printer, the dry adhesive is ruined and the individual labels of the label system including the dry adhesive are caused to loosen from the supporting support sheet or release paper resulting in that the individual labels of the label system are not correctly positioned relative to the support sheet or loosen from the support sheet which may further cause the laser jet to be jammed by the loose paper labels.

Label systems including plastic foils is also known from e.g. EP 0 389 112 and EP 0 488 813. The plastic foils of these known label systems, however, like the above described dry adhesive cannot stand exposure to the high to be used in conjunction with the lever arch file or ring binder.

An object of the present invention is to provide a label system including a number of individual paper labels which label system is readily printable in a laser jet or any similar printing machine such as an ink jet printer or a type writer which label system consequently renders it possible to provide a printing on a specific label for identifying a lever arch file or ring binder by means of the paper label.

The label system according to the present invention provides a specific advantage as compared to the conventional paper labels to be used in conjunction with lever arch files or ring binders as the label system renders it possible in a PC-controlled printer such as a laser printer or ink jet printer to provide the printing on a specific label or alternatively a set of labels identifying a set of lever arch files or ring binders in accordance with specific printing requirements such as requirements relating to typography.

A particular feature of the present invention relates to the fact that the label system according to the present invention may be readily employed for providing a multitude of labels or tags such as place cards, visiting cards, gift tokens, taking in to dinner-cards, name signs, conference signs or badges, tabel signs and identity cards.

A further feature of the present invention relates to the fact that the label system may include different labels or tags allowing the printing of a label system for identifying different objects belonging to a set of objects such as lever arch files or ring binders, books etc. belonging to a set to which set a further person identified through an ID-card and having congress signs and table signs may be identified. Alternatively, the label system including a plurality of identical labels or tags may be used for identifying different lever arch files, ring binders, books or the like in accordance with specific printing requirements etc.

The above object, the above advantage and the above features together with numerous other objects, advantages and features which will be evident from the below detailed description of the present invention are in accordance with the teachings of the present invention obtained by a label sytem, comprising a support sheet of a paper material, the support sheet defining opposite surfaces, an adhesive coating applied to one side of the support sheet, and a printing paper defining opposite front and rear surfaces, the rear surface of the printing paper being releasably fixated to the support sheet in facial contact therewith through the adhesive coating and the printing paper being divided into individual paper labels or paper tags which are individually removable from the support sheet.

The label system according to the present invention basically comprises a conventional printing paper or cardboard which is supported by the support sheet including the adhesive coating serving the purpose of fixating the printing paper relative to the support sheet and consequently the individual paper labels or paper tags of the printing paper relative to the support sheet.

In order to ensure that the paper labels or paper tags of the printing paper may be released from the support sheet after the label system has been used for its intentional purpose, i.e. for providing a printing on a specific paper label, the printing paper is preferably provided with a release coating at the rear surface thereof, which release coating faces and contacts the adhesive coating of the support sheet in the facial contact between the support sheet and the printing the support sheet and the printing paper of the label system according to the present invention may have any appropriate outer contour or configuration such as a rectangular, a quadratic, a circular, an elliptic or any polygonal configuration. The support sheet and the printing paper may further have different outer dimensions as the support sheet may be smaller than the printing paper or alternatively the printing paper may be smaller than the support sheet provided that the part of the support sheet which is uncovered by the printing paper is provided with a covering of an appropriate covering such as a paper covering. Preferably, the support sheet and the printing paper are, however, of identical outer dimensions such as outer dimensions in conformity with conventional paper standards such as the DIN standard A0–A6 including e.g. the conventional DIN A4 standard measuring 21 cm×29.7 cm. Alternatively, the support sheet and the printing paper may have e.g. the US folio standard dimensions measuring 8½ inch×14 inch (21.5 cm×35.6 cm) or any other appropriate dimensions such as Japanese B5 standard measuring 18.4 cm×25.7 cm or Japanese B4 standard measuring 36.4 cm×25.7 cm.

According to a highly advantageous embodiment of the label system according to the present invention, the support sheet is divided into two support sheet sections, one of which is removable from the label system for partly exposing the rear surface of the printing paper, thus, further exposing at least part of the rear surfaces of the paper labels or paper tags of the printing paper making it very easy to remove the paper labels or paper tags individually from the support sheet without causing any mechanical deformation or damage of the paper labels or paper tags.

The paper labels or paper tags of the printing paper of the label system according to the present invention preferably have dimensions corresponding to the dimensions of a receiving pocket of a lever arch file or ring binder with which at least one of the paper labels or paper tags is to be used.

The printing paper of the label system according to the present invention may constitute an un-printed or alternatively a pre-printed printing paper or cardboard having printings provided at the paper labels or paper tags such as printings identifying the manufacturer of the label system in question. Alternatively, the pre-printing may comprise e.g. pre-printed lines allowing the user to make a handwriting on a specific paper label or paper tag.

The adhesive coating of the support sheet of the label system according to the present invention may be constituted by any appropriate adhesive coating allowing that the adhesive coating is exposed to the high temperature treatment in e.g. a laser printer. Thus, the adhesive coating may be constituted by a solvent type adhesive coating, a hot melt adhesive coating or alternatively and preferably an acryl-emulsion coating being a water based, non-heat curable adhesive.

The above object, the above advantage and the above features together with numerous other objects, advantages and features which will be evident from the below detailed description of the present invention are in accordance with the teachings of the present invention obtained by a lever arch file or ring binder according to the present invention, comprising a support sheet of a paper material, said support sheet defining opposite surfaces, an adhesive coating applied to one side of said support sheet, a printing paper defining opposite front and rear surfaces, said rear surface of said printing paper being releasably fixated to said support sheet in facial contact therewith through said adhesive coating and said printing paper being divided into individual paper labels or paper tags which are individually removable from said support sheet, and said individual paper labels or paper tags having dimensions allowing said paper label or paper tag to be removably received within said receiving pocket at the back of said lever arch file or ring binder.

The lever arch file or ring binder according to the present invention further preferably comprise any of the features of a label according to the present invention as discussed above.

Figure 2:
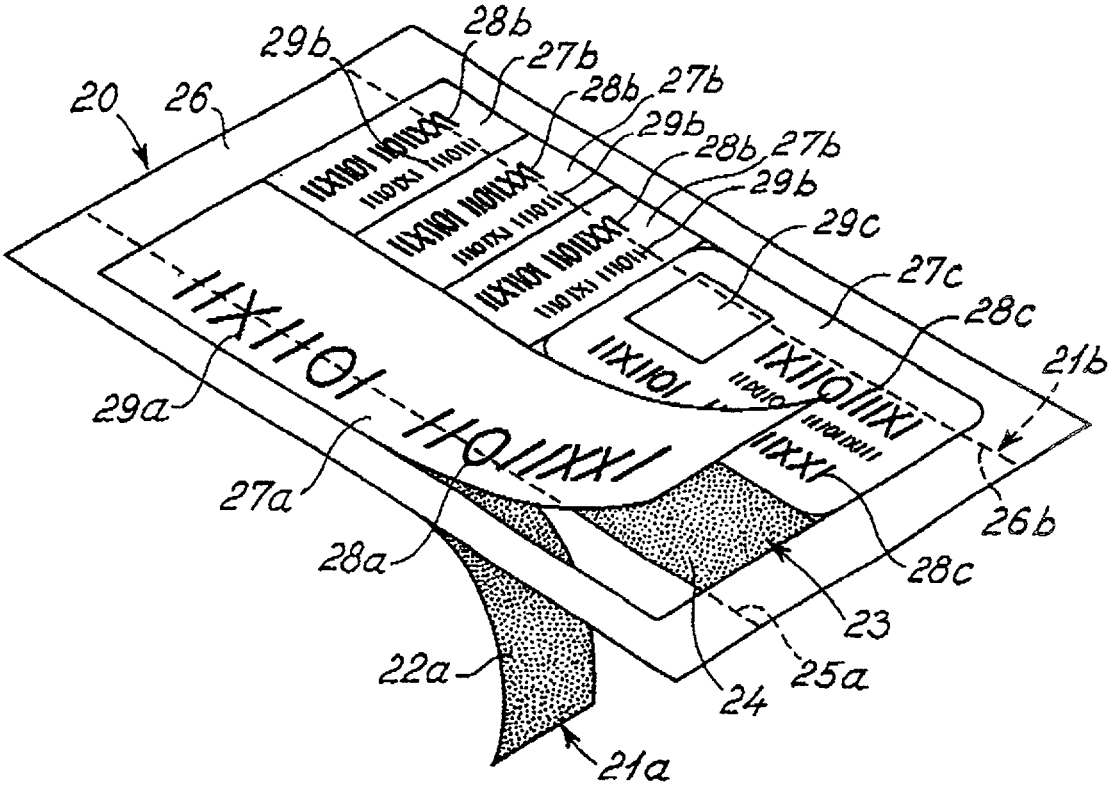
Figure 3:
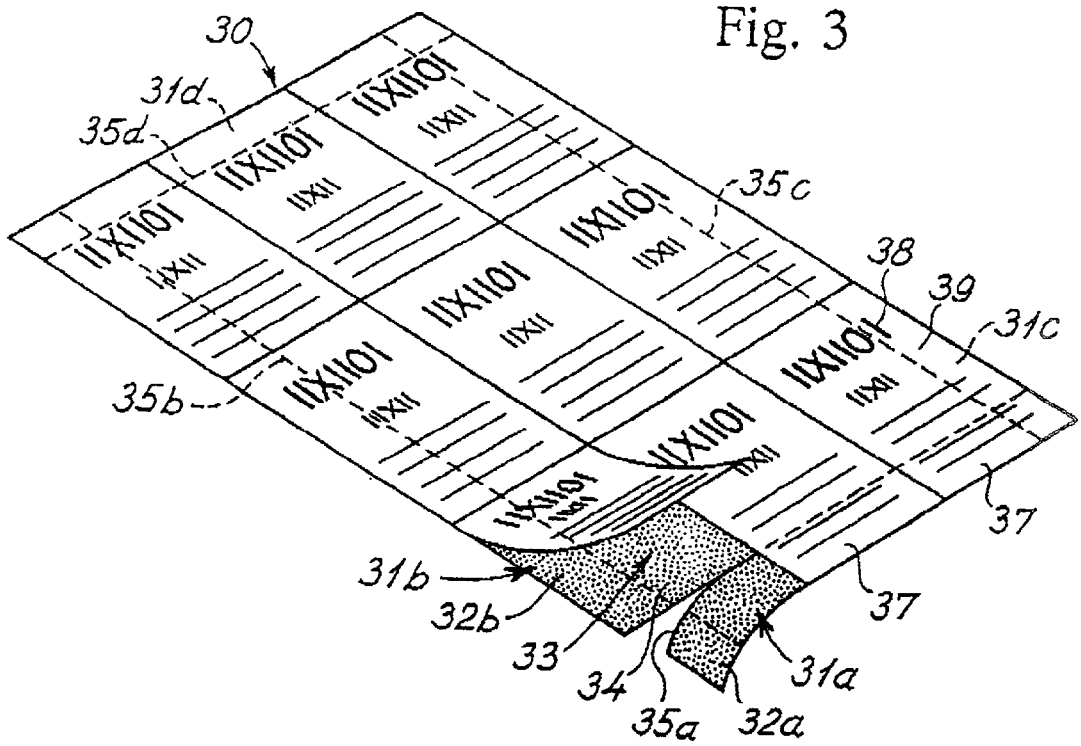
Figure 4:
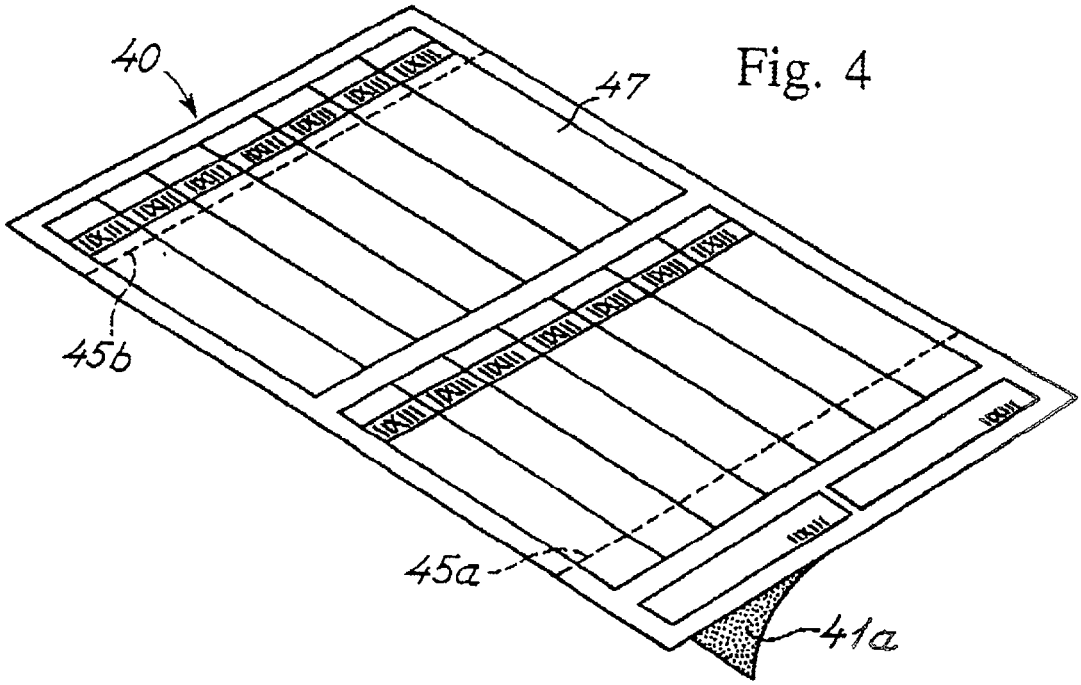
Figure 5:
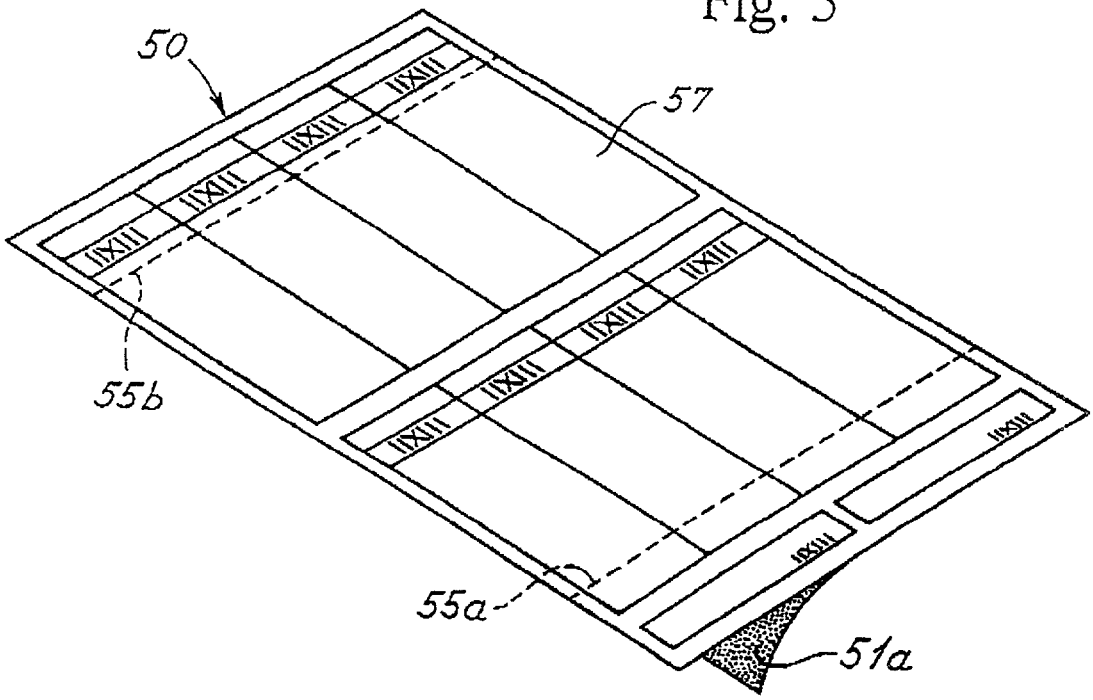
Figure 6:
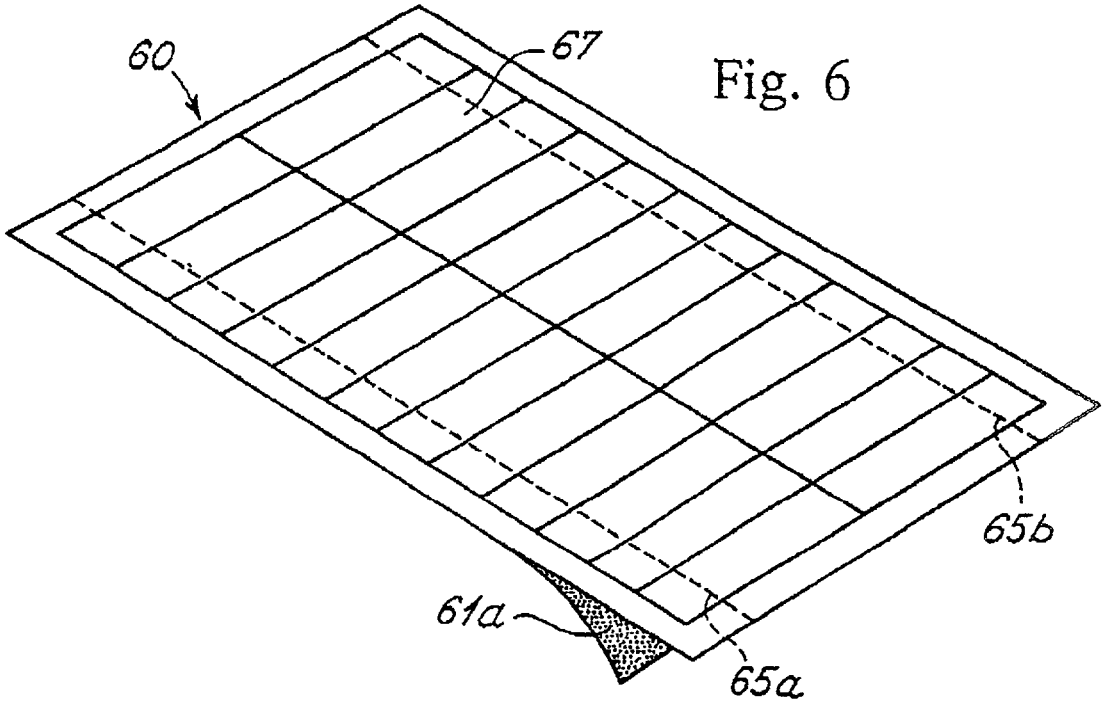
Figure 7:
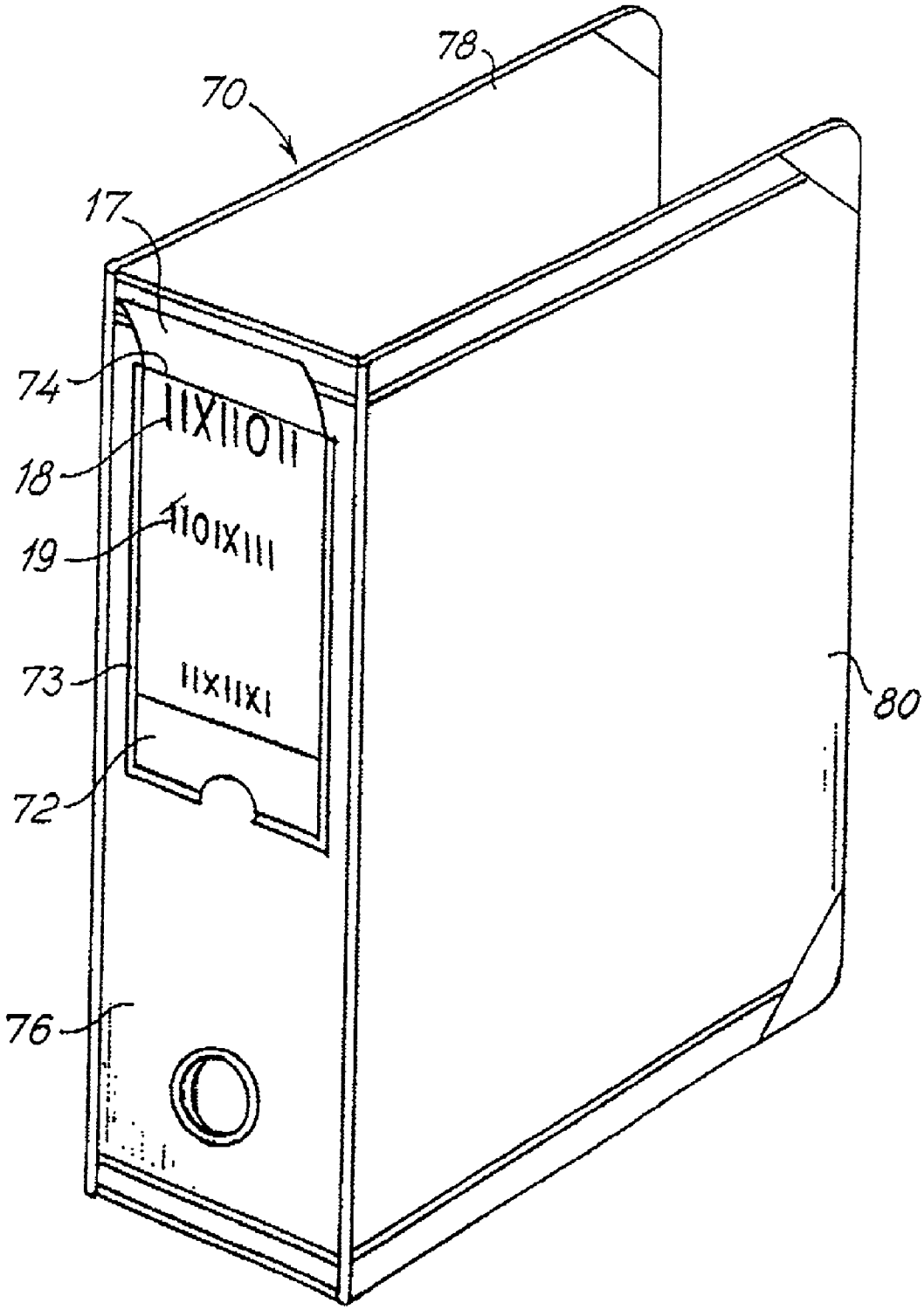

The present invention will now be further described with reference to the drawings in which FIG. 1 is a perspective and schematic view of a first embodiment of a label assembly according to the present invention, FIG. 2 is a perspective and schematic view similar to the view of FIG. 1 of a second embodiment of the label assembly according to the present invention, FIG. 3 is a perspective and schematic view similar to the views of FIGS. 1 and 2 of a third embodiment of the label assembly according to the present invention, FIG. 4 is a perspective and schematic view similar to the views of FIGS. 1–3 of a fourth embodiment of the label assembly according to the present invention, FIG. 5 is a perspective and schematic view similar to the views of FIGS. 1–4 of a fifth embodiment of the label assembly according to the present invention, FIG. 6 is a perspective and schematic view similar to the views of FIGS. 1–5 of a sixth embodiment of the label assembly according to the present invention, and FIG. 7 is a perspective and schematic view illustrating an advantageous application of the label assembly according to the present invention.

In FIG. 1, a first embodiment of a label assembly according to the present invention is shown designated the reference numeral 10 in its entirety. The label assembly basically comprises two paper sheets or similar sheets or foils one of which constitute a support sheet and one of which constitutes a printing paper. The support sheet of the label assembly 10 is constituted by two support sheet sections 11 and 13 which together define a support sheet of standard dimension DIN A4 measuring 21 cm×29.7 cm. The support sheet comprising the two sections 11 and 13 constitutes a continuous sheet divided into the two sections along a line of separation 15. Each of the support sheets sections 11 and 13 is provided with an adhesive front covering 12 and 14, respectively, serving the purpose of adhering the printing paper of the assembly 10 to the support sheet during storing of the sheet and also during the process of providing a printing on the front surface of the assembly. The printing paper constitutes like the support sheet a sheet of standard dimensions DIN A4 measuring 21 cm×29.7 cm. Whereas the support sheet is divided into two sections, the printing paper is divided or cut into a total of four labels or tags 17 which are circumferentially encircled by a paper rim section 16. The paper rim section 16 defines a substantially constant width. The width of the circumferential rim sectin 16 is furthermore, as is evident from FIG. 1, somewhat smaller than the width of the support sheet section 11. Each of the paper labels or tags 17 is provided with printings 18 and 19 which are identical to one another, as the labels or tags may be used for identifying items or products such as lever arch files, ring binders or books which are interdependent. Alternatively, the labels or tags 17 may be provided with different printings as the individual labels or tags may be used for identifying individual items or products such as individual lever arch files, ring binders or books.

The label assembly 10 is preferably produced from two continuous rolls of paper material one of which is used for the support sheet and another one of which is used for the printing paper. The support sheet may be supplied as a sheet including the adhesive coating and is separated into two continuous sections defining the support sheet sections 11 and 13 of the assembly 10. The printing paper is at its rear surface provided with a release coating and is before or after the printing paper is contacted with the two section support sheet cut into the configuration shown in FIG. 1 comprising the labels or tags 17 and the circumferential rim section 16. Numerous modifications of the process of producing the label assembly, are, however, obvious to a person having ordinary skill in the art, and the above description of a method of producing the label assembly is by no means to be construed limiting the present invention.

The label assembly 10 is preferably used for printing text on the labels 17 by means of e.g. a laser printer, an ink jet printer or alternatively a type writer. Provided a laser printer or ink jet printer is used, a personal computer connected to the printer in question is preferably provided with a program or a soft ware controlling the process of printing the text and controlling the registration of the printed text relative to the individual labels or tags 17. After the printing of the text such as the text 18 and 19 on the labels or tags 17 has taken place, the individual labels or tags 17 are separated from the supporting sheet in the following manner. Initially, the support sheet section 11 is separated from the adjacent support sheet section 13 revealing unexposed sections of the label or tag 17 which unexposed sections are easlily gripped by the user for removing the individual labels or tags from the support sheet section 13. In FIG. 1, the support sheet section 11 is illustrated in a bent down mode illustrating an initial state of separating the support sheet section 11 from the adjacent support sheet section 13. Also in FIG. 1, the right hand label or tag 17 is illustrated partly separated from the underlying support sheet section 13, the adhesive coating 14 of which is, thus, exposed.

In FIG. 2, a second embodiment of the label assembly according to the present invention is shown designated the reference numeral 20 in its entirety. In FIG. 2, elements or components similar to those of the first embodiment 10 described above with reference to FIG. 1 are designated the same reference numerals, however added the number 10. Thus, the reference numerals of the elements of the label assembly 20 shown in FIG. 2 are designated the reference numerals of the twenties.

Whereas the first embodiment 10 comprises two support sheet sections 11 and 13, the second embodiment 20 comprises three support sheet sections 21*a*, 21*b* and 23. The support sheet sections 21*a* and 21*b* basically constitute support sheet sections similar to the support sheet section 11 of the first embodiment 10 which are separated from the central support paper section 23 through lines of separation 25*a* and 25*b*. All three support sheet sections 21*a*, 21*b* and 23 are provided with adhesive front surface coatings among which the surface coatings of the support sheet sections 21*a* and 23 are disclosed in FIG. 2 and designated the reference numerals 22*a* and 23, respectively. In the above described first embodiment 10 of the label assembly, four identical paper labels or tags 17 are provided. In the second embodiment 20 shown in FIG. 2, three different configurations of paper labels or tags are provided. The label assembly 20, thus, includes a first major paper label 27*a* which is provided with printings 28*a* and 29*a*, three smaller size paper labels or tags 27*b* which are provided with printings 28*b* and 29*b* and further a third paper label or tag 27*c* which is provided with two printings 28*c* and an unmarked area 29*c* which serve the purpose of receiving a photograph, stamp or the like.

The printings 28*a*, 29*a*, 28*b*, 29*b* and 28*c* may be identical or different from one another dependent on the application of the label assembly. According to an advantageous and preferred application of the label assembly 20, the paper labels or tags 27*a*, 27*b* and 27*c* are used for identifying an individual participating in e.g. a conference or congress. Thus, the major size label 27*a* may serve as a sign board to be positioned on the table in front of the conference or congress participant, the minor size labels or tags 27*b* may be used for mounting within the receiving pocket of a lever arch file or ring binder, and the label or tag 27*c* may serve as a batch identifying the individual as a photograph of the individual is fixated within the unmarked area or frame 29*c* of the batch 27*c*. Like the above described first embodiment 10, the second embodiment 20 of the label assembly also comprises a circumferential paper rim section 26 encircling the paper labels or tags 27*a*, 27*b* and 27*c*.

In FIG. 3, a third embodiment of the label assembly according to the present invention is shown designated the reference numeral 30 in its entirety. In FIG. 3, elements or components of the third embodiment 30 similar to those of the first embodiment 10 described above with reference to FIG. 1 are designated the same reference numerals, however, added the FIG. 20. The third embodiment 30 basically differs from the above described first embodiment 10 in two aspects. Firstly, the circumferential outer rim 16 of the printing paper is omitted as the printing paper of the third embodiment is divided into a total of nine paper labels or tags 37 which are provided with printings 38 and 39 and further a set of printed lines for allowing an individual to make a hand written printing on the paper label or tag. Secondly, the third embodiment 30 differs from the above described first embodiment 10 described above with reference to FIG. 1 in that the support paper is divided into a center section 33 which is circumferential encircled by a total of four support sheet sections 31*a*, 31*b*, 31*c* and 31*d* which are separated from the central support paper section 33 through separation lines 35*a*, 35*b*, 35*c* and 35*d*, respectively. The support sheet including the central section 33 and the circumferentially encircling rim sections 31*a*, 31*b*, 31*c* and 31*d* is provided with an adhesive coating for adhering the printing paper to the support paper during storage and during the process of providing printings on the individual paper labels or tags of the printing paper as described above with reference to FIG. 1.

In FIGS. 4, 5 and 6, three additional embodiments constituting a fourth, a fifth and a sixth embodiment of the label assembly according to the present invention are shown designated the reference numerals 40, 50 and 60, respectively. The fourth, fifth and sixth embodiments basically corresponding to the above described first embodiment 10 in that each of the fourth, fifth and sixth embodiments include a plurality of identical paper labels or tags 47, 57 and 67, respectively. The labels or tags 47 and 57 shown in FIGS. 4 and 5, respectively, are positioned perpendicularly relative to the orientation of the paper labels or tags 17 of the label assembly 10 shown i FIG. 1 whereas the labels or tags 67 shown in FIG. 6 are positioned similar to the labels or tags 17 of the paper assembly 10 shown in FIG. 1. The fourth embodiment 40, the fifth embodiment 50 and the sixth embodiment 60 each includes a support paper which is divided into three sections similar to the sections 21*a*, 23 and 21*b* of the second embodiment 20 described above with reference to FIG. 2 and which are indicated in FIGS. 4–6 through dotted lines 45*a*/45*b*, 55*a*/55*b* and 65*a*/65*b*. In FIGS. 4, 5 and 6, downwardly bent outer ends of support sheet sections 41*a*, 51*a* and 61*a*, similar to the above described section 21*a* of the second embodiment 20 are also disclosed. The different dimensions of the labels or tags 47, 57 and 67 serve the purpose of providing labels or tags which are adapted to be received within specific receiving pockets of e.g. lever arch files or ring binders. The paper labels or tags 47 and 57 are intended to be used in connection with lever arch files and ring binders, whereas the paper labels or tags 67 are intended to be used in connection with inserts of suspension files.

In FIG. 7, an advantageous and preferred application of the paper labels or tags such as the paper labels or tags 17, 27*b*, 37, 47, 57 and 67 described above with reference to FIGS. 1–6, respectively, is illustrated. The reference numeral 70 designates a lever arch file or ring binder, the back of which is designated the reference numeral 76. At the top of the back 76 of the lever arch file or ring binder 70, a receiving pocket 72 is provided for receiving the paper label or tag of the present invention constituted by the above described first embodiment 17 which is provided with the printings 18 and 19. The pocket 72 is constituted by a rectangular, transparent foil which is fixated to the back 76 of the lever arch file or ring binder 70 through a welded seam 73. The pocket 72 defines an open upper end 74 through which the paper label or paper tag 17 is introduced into the pocket.

The above described embodiments of the label assembly according to the present invention is primarily intented to be used for printing labels such as labels to be used in conjunction with e.g. books, lever arch files or ring binders for identifying the book, lever arch file or ring binder. It is to be realized that the paper labels or tags such as the paper labels 17 described above with reference to FIG. 10 are none adhering paper labels or tags as the paper labels or tags are uncoated or preferably provided with a release backing coating allowing the paper labels or tags to be easily removed from the support sheet or paper which contrary to the printing paper is provided with a front surface adhesive coating for temporarily fixating the paper labels or tags of the printing paper relative to the support sheet or paper during the storage and the printing process. It is also to be realized that materials different from paper such as composite paper and plastics material or plastics materials may be used for the support sheet and/or the printing paper. Although the present invention has been described above with reference to numerous, presently preferred embodiments of the label assembly, the present invention is by no means to be construed limited to the above described embodiments as numerals modifications and amendments are really deduceable to a person having ordinary skill in the art. Such modifications and amendments are to be considered part of the present invention as defined in the appending patent claims.

The invention claimed is:

1. A label assembly, comprising:

a support sheet of a paper material, said support sheet comprising opposite surfaces and at least two support sheet sections;

an adhesive coating on one of said opposite surfaces of said support sheet; and a printing paper comprising opposite front and rear surfaces, said printing paper comprising a release coating on all of said rear surface, wherein said release coating on said rear surface of said printing paper is releasably fixated to and in facial contact with said adhesive coating on said support sheet, said printing paper is divided into individual paper labels which are individually removable from said support sheet with the adhesive coating remaining on the support sheet, and one of said support sheet sections traverses a plurality of said paper labels and is removable from said label assembly so as to partly expose the rear surface of said plurality of paper labels.

2. The label system according to claim 1, wherein said support sheet and said printing paper are of identical outer dimensions.

3. The label system according to claim 1, wherein said paper labels have dimensions such that said paper labels are positionable in a receiving pocket at a back of at least one of a lever arch file and a ring binder.

4. The label system according to claim 1, wherein said printing paper comprises unprinted printing paper.

5. The label system according to claim 1, wherein said adhesive coating is sufficiently hear resistant that said label assembly is printable in a laser printer exposing said label system to heat during a printing process.

6. The label system according to claim 1, wherein said printing paper comprises pre-printed paper having printings at said individual paper labels.

7. The label system according to claim 1, wherein said printing paper comprises cardboard.

8. The label system according to claim 1, wherein said adhesive coating is a water-based, non-heat curable adhesive coating.

9. The label system according to claim 2, wherein said support sheet and said printing paper are of standard dimensions DIN A4 measuring 21 cm×29.7 cm.

10. A system comprising:

a lever arch file including a receiving pocket at a back thereof; and a label system that includes:

a) a support sheet of a paper material, said support sheet having opposite surfaces and at least two support sheet sections;

b) an adhesive coating on one of said opposite surfaces of said support sheet;

c) a printing paper comprising opposite front and rear surfaces, said printing paper comprising a release coating on all of said rear surface;

wherein said release coating on said rear surface of said printing paper is releasably fixated to and in facial contact with said adhesive coating on said support sheet, said printing paper is divided into individual paper labels which are individually removable from said support sheet with the adhesive coating remaining on the support sheet, and one of said support sheet sections traverses a plurality of said paper labels and is removable from said label assembly so as to partly expose the rear surface of said plurality of paper labels, and said individual paper labels or paper rags have dimensions such that said paper labels are removably receivable within said receiving pocket at the back of said lever arch file.

11. The label system according to claim 10, wherein said support sheet and said printing paper are of identical outer dimensions.

12. The label system according to claim 9, wherein said support sheet and said printing paper are of standard dimensions DIN A4 measuring 21 cm×29.7 cm.

13. A label assembly, comprising:

a support sheet of a paper material, said support sheet comprising opposite surfaces;

an adhesive coating on one of said opposite surfaces of said support sheet; and a printing paper comprising opposite front and rear surfaces, said printing paper comprising a release coating on all of said rear surface, wherein said release coating on said rear surface of said printing paper is releasably fixated to and in facial contact with said adhesive coating on said support sheet, said printing paper is divided into individual paper labels which are individually removable from said support sheet with the adhesive coating remaining on the support sheet, and said support sheet comprises at least two support sheet sections, one of said support sheet sections traverses a plurality of said paper labels and is removable from said label assembly so as to partly expose said rear surface of said plurality of paper labels.

14. The label assembly according to claim 13, wherein said support sheet and said printing paper are of identical outer dimensions.

15. The label assembly according to claim 14, wherein said support sheet and said printing paper are of standard dimensions DIN A4 measuring 21 cm×29.7 cm.

16. A label assembly, comprising:

a support sheet of a paper material, said support sheet comprising opposite surfaces and at least two support sheet sections;

an adhesive coating on one of said opposite surfaces of said support sheet; and a printing paper comprising opposite front and rear surfaces, said printing paper comprising a release coating on all of said rear surface, wherein said release coating on said rear surface of said printing paper is releasably fixated to and in facial contact with said adhesive coating on said support sheet, said printing paper is divided into individual paper labels which are individually removable from said support sheet with the adhesive coating remaining on the support sheet, and one of said support sheet sections traverses a plurality of said paper labels and is removable from said label assembly so as to partly expose the rear surface of said plurality of paper labels, and said printing paper is selected from the group consisting of unprinted printing paper, printing cardboard, a pre-printed printing paper and priming cardboard having printings at said individual paper labels.

17. The label assembly according to claim 16, wherein said support sheet and said printing paper are of identical outer dimensions.

18. The label assembly according to claim 16, wherein said support sheet and said printing paper are of standard dimensions DIN A4 measuring 21 cm×29.7 cm.

19. The label assembly according to claim 16, wherein said paper labels have dimensions such that said paper labels are positionable in a receiving pocket of at least one of a lever arch file and a ring binder.

20. A label assembly, comprising:

a support sheet of a paper material, said support sheet comprising opposite surfaces and at least two support sheet sections;

an adhesive coating on one of said opposite surfaces of said support sheet; and a printing paper comprising opposite front and rear surfaces, said printing paper comprising a release coating on all of said rear surface, wherein said release coating on said rear surface of said printing paper is releasably fixated to and in facial contact with said adhesive coating on said support sheet, said printing paper is divided into individual paper labels which are individually removable from said support sheet with the adhesive coating remaining on the support sheet, and one of said support sheet sections traverses a plurality of said paper labels and is removable from said label assembly so as to partly expose the rear surface of said plurality of paper labels, and said adhesive coating is sufficiently heat resistant that said label assembly is printable in a printer exposing said label system to heat during a printing process.

21. The label assembly according to claim 20, wherein said support sheet and said printing paper are of identical outer dimensions.

22. The label assembly according to claim 20, wherein said paper labels have dimensions such that said paper labels are positionable in a receiving pocket of at least one of a lever arch file and a ring binder.

23. The label assembly according to claim 20, wherein said printing paper is selected from the group consisting of unprinted printing paper, printing cardboard, a pre-printed printing paper, and printing cardboard having printings at said individual paper labels.

24. The label system according to claim 20, wherein said adhesive coating is a water-based, non-heat curable adhesive coating.

25. The label assembly according to claim 21, wherein said support sheet and said printing paper are of standard dimensions DIN A4 measuring 21 cm×29.7 cm.

26. A ring binder comprising a label system, said ring binder comprising a receiving pocket at a back thereof, and said label system comprising:

a support sheet of a paper material, said support sheet comprising opposite surfaces and at least two support sheet sections;

an adhesive coating on one of said opposite surfaces of said support sheet;

a printing paper comprising opposite front and rear surfaces, said printing paper comprising a release coating on all of said rear surface, wherein said release coating on said rear surface of said printing paper is releasably fixated to and in facial contact with said adhesive coating on said support sheet, said printing paper is divided into individual paper labels which are individually removable from said support sheet with the adhesive coating remaining on the support sheet, and one of said support sheet sections traverses a plurality of said paper labels and is removable front said label assembly so as to partly expose the rear surface of said plurality of paper labels, and said individual paper labels or paper tags have dimensions such that said paper labels are removably receivable within said receiving pocket at the back of said ring binder.

* * * * *